US006367658B1

(12) United States Patent
Kenney et al.

(10) Patent No.: US 6,367,658 B1
(45) Date of Patent: Apr. 9, 2002

(54) WINDSHIELD WASHER FLUID DISPENSING SYSTEM

(76) Inventors: David Joseph Kenney; Rebecca Beauregard Kenney, both of 3907 - 4th Ave. NE., Bradenton, FL (US) 34208

( * ) Notice: Subject to any disclaimer, the term of this patent is extended or adjusted under 35 U.S.C. 154(b) by 0 days.

(21) Appl. No.: 09/620,118

(22) Filed: Jul. 20, 2000

(51) Int. Cl.[7] ..... B67D 5/30
(52) U.S. Cl. ..... 222/14; 222/71; 222/183
(58) Field of Search ..... 222/14, 26, 71, 222/145, 183, 108, 20; 137/239.6

(56) References Cited

U.S. PATENT DOCUMENTS 4,131,215 A * 12/1978 Hansel ..... 222/26
4,397,405 A * 8/1983 Batson ..... 222/14
5,865,346 A * 2/1999 Del Zotto ..... 222/108

* cited by examiner

*Primary Examiner*—Philippe Derakshani
*Assistant Examiner*—Thach H Bui
(74) *Attorney, Agent, or Firm*—Dorothy S. Morse

(57) ABSTRACT

A coin/credit-card/debit-card and credit card activated windshield washer fluid dispensing system that is economically constructed with a minimum number of electrical components, and which is particularly suitable for retrofitting to existing housings built for other dispensing purposes. Through use of the present invention an operator can neatly transfer a metered amount of windshield washer fluid directly into a motor vehicle windshield fluid reservoir under low pressure without the use of a funnel. The system can be used as a stand-alone unit or combined in a housing with other automotive-related systems, such as air/vacuum service units. A first preferred embodiment comprises a timer, pump, and solenoid all operating under standard current whereby upon opening the solenoid and pump activation, windshield washer fluid is transferred from a tank to a low pressure regulator for a pre-determined amount of time. A second preferred embodiment is even simpler in construction than the first preferred embodiment, and lower in cost since it has no pump, wherein windshield washer fluid is gravity-fed from an elevated tank, through the opened solenoid, subsequently through a low pressure regulator and into a dispensing hose. Through use of the variable timer and regulator, the dispensing system can be precisely calibrated to dispense a fixed maximum amount of fluid per unit payment at a chosen dispensing speed. Applications would include, but not be limited to, use in association with car washes, convenience stores, gas stations, rental car facilities, and maintenance garages for buses and other fleet vehicles.

20 Claims, 5 Drawing Sheets

WINDSHIELD WASHER FLUID DISPENSING SYSTEM

BACKGROUND

1. Field of Invention

This invention relates to coin and credit card operated dispensers, specifically to a coin, credit card, and/or debit card activated windshield washer fluid dispensing system that can be manufactured as a stand-alone unit or combined into a single housing with one or more independent systems providing motor vehicle related services, such as air/vacuum services. The present invention has a compact configuration, a minimum number of parts, and electrical components that operate on standard current to make it particularly suited for low cost retrofit into existing housings built for other dispensing purposes. Activation of the present invention provides prompt, gentle operation for spill-free windshield washer fluid dispensing without the use of a funnel. In a first preferred embodiment, upon payment receipt, a timer simultaneously activates an electric pump and opens a solenoid to draw windshield washer fluid from a tank and continually supply such fluid to an adjustable fluid flow regulator for a pre-determined period of time so that a fixed maximum amount windshield washer fluid can be made to flow under low pressure through a connected dispensing hose and thereafter into the windshield fluid reservoir of a motorized vehicle. The dispensing hose comprises a nozzle having an easily operator-controlled fluid cut-off valve to prevent reservoir overfill. (A second preferred embodiment is simpler in construction and lower in cost to manufacture than the first preferred embodiment since it has no pump. In the second preferred embodiment, upon payment receipt, a timer opens a solenoid to allow windshield washer fluid in an elevated tank to be gravity-fed through the opened solenoid, through an adjustable fluid flow regulator, and into a dispensing hose. Applications would include, but not be limited to, use in association with car washes, convenience stores, gas stations, rental car facilities, and maintenance garages for buses and other fleet vehicles.

2. Description of Prior Art

Windshield visibility is critical to safe driving and a readily available supply of windshield washer fluid in a vehicle's reservoir is crucial to maintaining optimum windshield visibility. A previous invention by the same inventors herein, U.S. Pat. No. 5,957,329 to Kenney (1999), provides units for windshield washer fluid dispensing at facilities where motorists regularly service their vehicles, thus prompting motorists to regularly check the fluid level in their windshield washer reservoirs and keep them filled to optimum levels for good windshield washing system performance. The previous Kenney invention provided wall-mounted, standalone, gravity-fed, and combination windshield washer fluid dispensers that were easy to operate by the public, promptly delivered windshield washer fluid in a reasonable amount of time, were able to neatly dispense windshield washer fluid directly into the vehicle's reservoir without splashing and without the use of a funnel, and had provisions for steady and even fluid flow which the operator could promptly cut-off as needed to prevent reservoir overfill. The previous Kenney invention used readily available 24-volt components and required a step-down transformer. The present invention provides a more simplified dispensing system having fewer parts that is cheaper to construct. In addition to eliminating the need for an air compressor, the present invention also eliminates the need for a step-down transformer to supply power to its timer and coin/credit-card/debit-card acceptor, and either provides for simultaneous electrical activation of a pump and a solenoid, or elimination of the pump wherein the windshield washer fluid is gravity-fed through an opened solenoid and an adjustable fluid flow regulator to the dispensing hose.

Another fluid vending machine that can be used to dispense windshield cleaning fluid is disclosed in U.S. Pat. No. 5,967,366 to Cason (1999). However, the Cason invention can also be distinguished from the present invention. Windshield washer fluid in the Cason invention is gravity-fed from an elevated primary reservoir into a measuring reservoir, and then subsequently into a dispensing tube. There is no direct fluid communication between the primary reservoir and the dispensing tube. Fluid from the primary reservoir reaches the dispensing tube as a crank is moved by an operator between starting and activation positions, and back again to sequentially close and open a pair of crank actuated poppet valves that are biased by springs into closed positions when the crank is midway between the starting and activation positions. Non-stretchable tethers attached between the crank and the poppet valves are used to alternatively open and close them. In the crank's starting position, the first poppet valve is closed and the measuring reservoir is isolated from the primary reservoir, while the second poppet valve is open to allow fluid communication between the measuring reservoir and the dispensing tube. As the crank is moved into its activation position, midway between the starting and actuation positions, the second poppet valve closes to isolate the measuring reservoir from the dispensing tube. When the crank is further moved toward the actuation position, the first poppet valve opens to allow fluid from the primary reservoir to be gravity-fed into the measuring reservoir. When the measuring reservoir is full, an operator would move the crank back toward the starting position. Midway between the actuation and starting positions, the first poppet valve closes to isolate the measuring reservoir from the primary reservoir. When the crank is further moved toward the starting position, the second poppet valve opens to allow fluid from the measuring reservoir to be gravity-fed through the dispensing tube.

Fluid measurement in the Cason invention is the result of a mechanical operation, while fluid measurement in the present invention is controlled in combination by an electrical timer and a low pressure fluid regulator. While the amount of fluid dispensed by the present invention for a given cost is adjustable and easily calibrated, the amount of fluid dispensed by the Cason invention depends on the size of the measuring reservoir and is not as easily altered. Further, the present invention has a safety advantage over the Cason invention in that the present invention allows the operator to control the amount of fluid leaving its dispensing hose. In the Cason invention, all of the fluid allowed to enter the measuring reservoir is gravity-fed through the dispensing tube, even if that amount of fluid would cause an automobile windshield fluid reservoir to overflow. In contrast, an operator of the present invention pays for dispensing time during which a calibrated flow of fluid is available for dispensing. As a result, an operator can prevent motor vehicle windshield fluid reservoir overfill by simply closing the fluid cut-off valve in the dispensing hose nozzle to cut off flow of excess fluid from the dispensing hose. Once the light in the present invention ceases to be lit, the operator will know that the dispensing period is complete and the cut-off valve can be safely released without fluid spills and waste. Further, the present invention is easier and faster to operate than the Cason invention, and the Cason invention would not be as easily retrofitted as the present invention to existing housings built to provide other automobile related services. In the present invention, after payment receipt, fluid flow is immediate, calibrated to flow under low pressure, and can be stopped at any time. In contrast, after payment receipt, an operator of the Cason invention must move a crank between a starting position and an activation, wait until the measuring reservoir is filled, and then move the crank again back to the starting position for fluid flow to occur. Also, all of the fluid in the measuring reservoir is dispensed, and any excess fluid is either wasted or if left in the dispensing tube becomes a safety hazard for curious children. No windshield fluid dispensing system is known that has all of the advantages of the present invention.

SUMMARY OF INVENTION—OBJECTS AND ADVANTAGES

It is the primary object of this invention to provide a simplified metered windshield washer fluid dispensing system with minimal parts for cost effective construction that operates under low pressure for gentle operation to furnish a steady, prompt, and even stream of windshield washer fluid to the windshield fluid reservoir of a motor vehicle, and in which fluid flow through the dispensing hose is operator-controlled with a nozzle having a cut-off valve to prevent reservoir overfill. It is also an object of this invention to provide a windshield washer fluid dispensing system that requires no air compressor and no step-down transformer. A further object of this invention is to provide a windshield washer fluid dispensing system that causes no spray, splashing, mess, or waste during proper customer use, directly and expediently fills the windshield fluid reservoir of a motor vehicle without the use of a funnel, and wherein the pressure and dispensing time can be easily calibrated by the vendor. It is also an object of this invention to provide a quiet and compact windshield washer fluid dispensing system that is easy for a customer to use and which can be made as an independent unit or easily retrofitted to coin/credit-card/debit-card operated systems already in use at gas stations, convenience stores, and car washes, for the dispensing of other motor vehicle related products or services, including air and vacuum services.

As described herein, properly manufactured and used, the present invention would provide a means by which motorists could neatly refill the windshield washer fluid reservoirs in their vehicles on a regular basis without the use of a funnel and without spillage. Conspicuous placement near to vehicle servicing locations at car washes, gas stations, and convenience stores would help to remind motorists to refill their windshield washer fluid reservoirs at the same time they refuel or provide other services to their vehicle. Although the present invention could be used as a stand-alone unit with one or more dispensing nozzles attached thereto, the most preferred embodiment of the present invention has its windshield washer fluid tank positioned on top of the type of housing commonly used for providing air and vacuum services to motor vehicles, so that minimal modifications are needed to existing housings to retrofit them with the present invention, unless additional modifications would be required in high crime locations as a defense against vandalism and theft. When adequate space is available within an existing air and vacuum services housing, the windshield washer fluid tank could optionally be placed within it, although owners may want to maintain the top positioned tank and make it distinguishable by color or design to provide an eye-catching configuration that is readily recognizable by customers and which would act as an instant reminder for customers to use the windshield washer fluid dispensing service. In addition to providing a futuristic design, the positioning of a partially partially flattened oval or round tank atop the housing also minimizes its use as a target for vandalism and provides easy access to the tanks for filling or exchange. For housings used in high traffic areas, it is contemplated for more than one partially flattened oval or round windshield washer fluid tank to be stacked upon one another, and optionally placed in fluid communication with one another, to minimize the number of maintenance visits needed to keep the system provided with a supply of windshield washer fluid adequate for the anticipated customer demand. A first preferred embodiment of the present invention would comprise a partially flattened oval or round tank of windshield washer fluid positioned on top of a housing adequate in size for use with the present invention and equipment providing other motor vehicle services, such as air and vacuum services; a timer; a light; a coin, credit card, and/or debit card acceptor; a electric pump; a first hose or fluid tube connected between the tank and the pump; a solenoid; a low pressure adjustable fluid flow regulator; a dispensing nozzle with an elongated dispensing tip and a fluid cut-off control; a second flexible hose connected between the regulator and the dispensing nozzle; a standard current power cord; electrical wiring connected between the coin/credit/debit acceptor and the timer, the timer and the light, the timer and the pump, as well as the timer and the solenoid; the coin/credit/debit acceptor, timer, light, pump, and solenoid all operating on standard current; and means for supporting the dispensing nozzle during periods of non-use. A second preferred embodiment of the present invention would be gravity-fed and comprise a partially flattened oval or round tank of windshield washer fluid positioned on top of a housing for equipment providing other vehicle services, such as air and vacuum services; a timer; a light; a coin, credit card, and/or debit card acceptor; a solenoid; a first hose connected between the tank and the solenoid; a low pressure adjustable fluid flow regulator; a dispensing nozzle with an elongated dispensing tip and a fluid cut-off control; a second hose connected between the regulator and the dispensing nozzle; a standard current power cord; electrical wiring connected between the coin/credit/debit acceptor and the timer, the timer and the light, and the timer and the solenoid; the coin/credit/debit acceptor, timer, light, and solenoid all operating on standard current; as well as means for supporting the dispensing nozzle during periods of nonuse. The distal end of the nozzle in all preferred embodiments would be tapered and sufficiently small to fit within the size of fill opening found in most motor vehicle windshield washer fluid reservoirs. Optionally, the present invention can have an independent coin box and its own electrical enclosure, or share a single coin box and electrical enclosure with the other vehicle services located within the housing. An independent coin box and electrical enclosure would provide more rapid retrofitting of the present invention to an existing housing built for other dispensing purposes. The dispensing nozzle in all embodiments would have a cut-off control that is easily operable by a motorist to prevent windshield fluid reservoir overfill. Upon payment receipt, either with a coin, or a credit or debit card, the present invention would be activated and cause dispensing of a calibrated flow of windshield washer fluid for a pre-determined period of time. Through adjustment of the fluid flow regulator, the timer, or both, the system of the present invention could be calibrated to dispense differing amounts of windshield washer fluid for a given cost and the unit amount of windshield washer fluid available for dispensing would depend upon the profit desired by the vendor. If the system was owner-calibrated for one payment amount to fill an average vehicle reservoir to approximately seventy-five percent of its fluid capacity, and the reservoir to be filled was already one-third full, the operator would have to manipulate the nozzle cut-off control after the reservoir was filled to capacity until the system again became inactive to prevent reservoir overfill. In contrast, if the system was owner-calibrated to fill motor vehicle reservoirs to an approximate fifty percent capacity per unit payment, and the reservoir to be filled was already one-fourth full, the operator would dispense one timed quantity of windshield washer fluid into the reservoir without use of the nozzle cut-off control, and then choose whether to pay for a second timed period of dispensing and manipulate the nozzle cut-off control half-way through the dispensing period when the reservoir becomes full to prevent fluid spilling and waste. To confirm the duration of the dispensing period and thereby help operators know when to release the nozzle cut-off control at the end of the dispensing period without causing fluid spills, an on-off light on the front of the electrical enclosure would become illuminated during dispensing and cease to be illuminated when dispensing had stopped. Thus, the present invention would provide for quiet and expedient filling of a motor vehicle windshield washer fluid reservoir with no spray, no splashing, no mess, no waste, and no need for use of a funnel.

The description herein provides preferred embodiments of the present invention but should not be construed as limiting the scope of the windshield washer fluid dispensing system invention. For example, variations in the number of dispensing hoses, nozzles, and holsters used, the length dimension of the dispensing hoses used, the number, configuration, and capacity of the fluid tanks used for holding windshield washer fluid, and the type, dimension, and configuration of pump used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
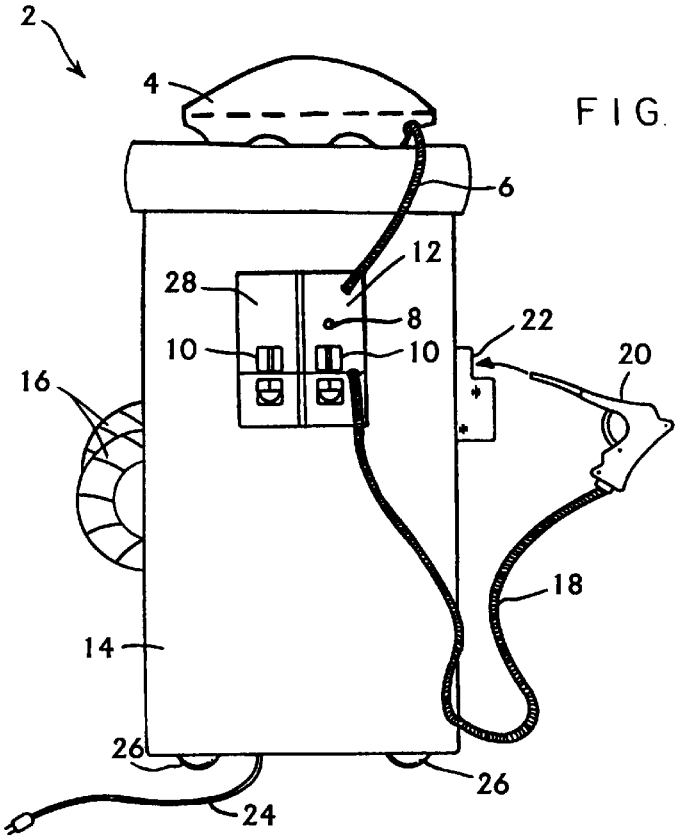
FIG. 1 is a front view of either the first or second preferred embodiment of the present invention combined into a housing unit with an independent system offering air and vacuum services to a motorist, the present invention having a partially flattened oval or round windshield washer fluid tank mounted atop the air and vacuum services housing and having an electrical enclosure separate from the air and vacuum services system.

The present invention discloses a coin, credit card, and/or debit card activated system that dispenses windshield washer fluid directly into a motor vehicle reservoir (not shown) simply, rapidly, and in a spill-free manner without the use of a funnel. The present invention can be manufactured as a stand-alone unit with a height dimension sufficient for allowing gravity-fed flow of windshield washer solution when required, or combined into a housing built for other dispensing purposes, such as an air/vacuum services housing as shown in FIG. 1. It is contemplated for the present invention to have an efficient and compact configuration so that when it is retrofitted into existing housings already functioning to provide other services, it can be quickly and easily installed with a minimum of effort and expense. Further, when jointly housed with a system providing other services, the present invention could have its own have its own coin, credit card, and/or debit card activation means, as shown in FIG. 1, or it could to share electrical activation means with jointly housed systems. A separate pre-wired electrical box, such as electrical enclosure 12 shown in FIG. 1, with its own timer would be preferred and provide several advantages, including easier calibration of dispensing time and speed of fluid flow, as well as less down time since the entire electrical enclosure 12 could be promptly changed-out and replaced by a new electrical enclosure 12 in the event of a failure in any electrical component. When shared electrical activation means are used, it is contemplated that a button, switch, or similar device would be provided, where applicable, to allow customers to select the service and/or product desired once payment is made. A first preferred embodiment of the present invention windshield washer fluid dispensing system 2 uses standard current to cause a timer 30 to simultaneously activate an electric pump 36 and a solenoid 38 so that pump 36 can draw windshield washer fluid (not shown) from a tank 4 and continually supply such fluid through solenoid 38 for a specified amount of time to a low pressure regulator 40 that can be adjusted to control the speed of windshield washer fluid dispensing, in order that windshield washer fluid can be made to flow evenly and under low pressure through a connected dispensing hose 18 and thereafter, safely, promptly, and neatly through a dispensing nozzle 20 and into the windshield fluid reservoir of a motorized vehicle (not shown), with pump 36, solenoid 38, and regulator 40 all being efficiently and compactly connected together within an electrical enclosure 12. Since the operator pays for dispensing time an operator-controlled fluid cut-off valve (not shown) connected to nozzle 20 would prevent motor vehicle reservoir overfill and fluid waste. A second preferred embodiment of the present invention is even simpler in construction than the first preferred embodiment, and lower in cost, since it has no pump 36 and the windshield washer fluid is gravity-fed from an elevated tank 4, through an opened solenoid 38, through a low regulator 40 and into a dispensing hose 18. Applications would include, but not be limited to, use in association with car washes, convenience stores, gas stations, rental car facilities, and maintenance garages for buses and other fleet vehicles.

FIG. 1 shows the present invention windshield washer fluid dispensing system 2 sharing a housing 14 with a system that provides air/vacuum services. FIG. 1 could represent either a new unit manufactured to provide both types of services jointly within housing 14, or an existing housing 14 built to provide air/vacuum services with the present invention retrofitted therein to expand the functionality and profitability of housing 14. The configuration of housing 14 is not critical and it could have a round, square, or other cross-sectional configuration, however it is contemplated that the housing 14 used for gravity-fed embodiments would have a sufficient height dimension for precisely calibrated gravity-fed dispensing of windshield washer fluid (not shown). Further, housing 14 should have adequate height dimension that allows convenient operator use without bending or stooping, and an overall configuration and construction that minimizes manufacturing cost and damage due to weathering element, attempted theft of coin vault 46 shown in FIG. 2, and vandalism. The present invention is simple is design, requiring the support and protection of a housing 14, one or more tanks 4 which are each contemplated for holding windshield washer fluid (not shown), an electrical enclosure 12 in which all of the electrically connected components of the present invention are located, and fluid delivery means through which windshield washer fluid leaves electrical enclosure 12, comprising a discharge hose 18, a dispensing nozzle 20 connected to the distal end of discharge hose 18 and having an elongated dispensing tip as well as an operator-controlled cut-off valve (not shown), and a conveniently positioned holster 22 attached to housing 14 for support of nozzle 20 during periods of non-use. FIG. 1 shows tank 4 located on top of housing 14 and in fluid communication with one upper corner on the front surface of electrical enclosure 12 by means of a fluid tube 6. Although external positioning of tank 4 relative to housing 14 is not critical, it is preferred since installation of the present invention is simplified and only modification of housing 14 to accommodate electrical enclosure 12 is then required. Internal positioning of tank 4 within housing 14 is only contemplated where vandalism is a concern and housing 14 is sufficient in size to contain one or more tanks 4. Since tank 4 is in the elevated position relative to dispensing hose 18 needed for gravity-fed fluid dispensing, the windshield washer fluid dispensing system 2 shown in FIG. 1 could represent either the first or second preferred embodiment of the present invention.

Figure 2:
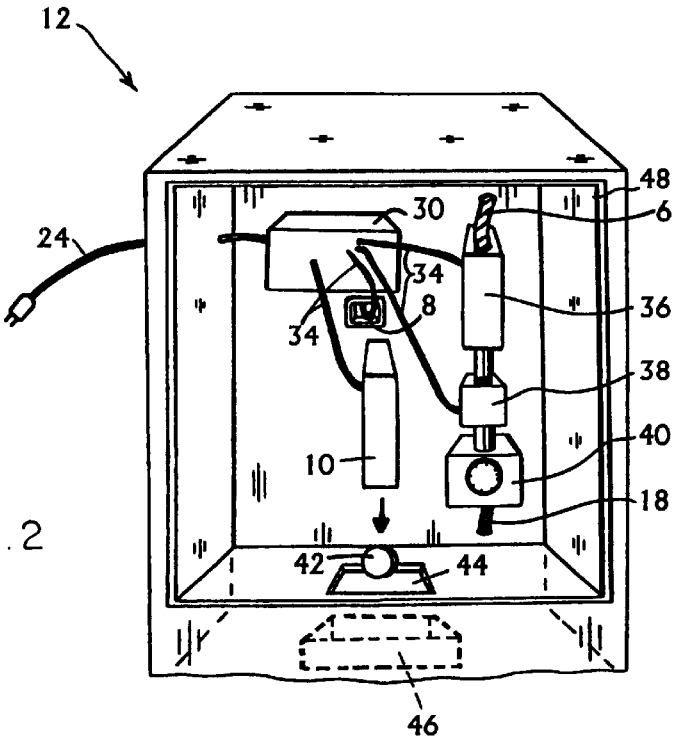
FIG. 2 is an enlarged front view of the electrical enclosure of the pump-activated first preferred embodiment of the present invention.

FIG. 1 shows the air/vacuum services and windshield washer dispensing services being activated through separate electrical control boxes with independent coin/credit-card/debit-card acceptors 10. Activation of the air/vacuum services is achieved through the coin/credit 14 card/debit-card acceptor 10 centrally positioned through electrical panel 28, with the air/vacuum services being dispensed through hoses 16. The remaining components for providing air/vacuum services are hidden within housing 14 or electrical panel 28 where they would be protected from weathering elements and vandalism, and are not identified in detail herein since they provide no working components for the present invention. FIG. 1 shows windshield washer fluid dispensing system 2 having a coin/credit-card/debit-card acceptor 10 centrally positioned through its separate electrical enclosure 12 with a light 8 positioned above coin/credit-card/debit-card acceptor 10. As shown in FIG. 2, coin/credit-card/debit-card acceptor 10 must be positioned within electrical enclosure 12 so as to allow the dropping of a coin 42 into a coin vault 46. As long as clearance is provided for entry of coins 42 into coin vault 46, coin/credit-card/debit-card acceptor 10 may be positioned through the front surface of electrical enclosure 12 in any position otherwise found to be convenient. Also, light 8 may be positioned anywhere through the front of electrical enclosure 12 as long as it is in a conspicuous position to inform operators (not shown) when active dispensing of windshield washer fluid occurs so as to minimize inadvertent spills and motor vehicle windshield reservoir overfill. Also, the type of light source used for light 8 is not critical, although standard current is preferred to simplify manufacture and reduce manufacturing cost. In FIG. 1, electrical enclosure 12 is shown positioned adjacent to electrical panel 28, although such positioning is not critical and the location of electrical enclosure 12 may depend on the positioning of components already existing in housing 14 that relate to the providing of other motor vehicle services. When possible, the positioning of electrical enclosure 12 should provide for customer convenience in accessing coin/credit-card/debit-card acceptor 10 and also allow bolting of electrical enclosure 12 to electrical panel 28, as added security against vandalism, particularly when electrical enclosure 12 is retrofitted into housing 14. The use of independent electrical controls for windshield washer fluid dispensing system 2 and other motor vehicle related systems, such as the electrical enclosure 12 and the electrical panel 28 shown in FIG. 1, is not critical. However, independent electrical controls are preferred for retrofitted installation of windshield washer fluid dispensing system 2 since the wiring of components within electrical enclosure 12 to electrical panel 28 would require a greater amount of installation time. Also, independent electrical controls would allow continued operation of each system in the event that a jointly housed system would fail, and less down time in the operation of the present invention since the entire electrical enclosure 12 could be promptly changed-out and replaced by a new electrical enclosure 12 in the event of a failure in any electrical component or its low pressure regulator.

Figure 4:
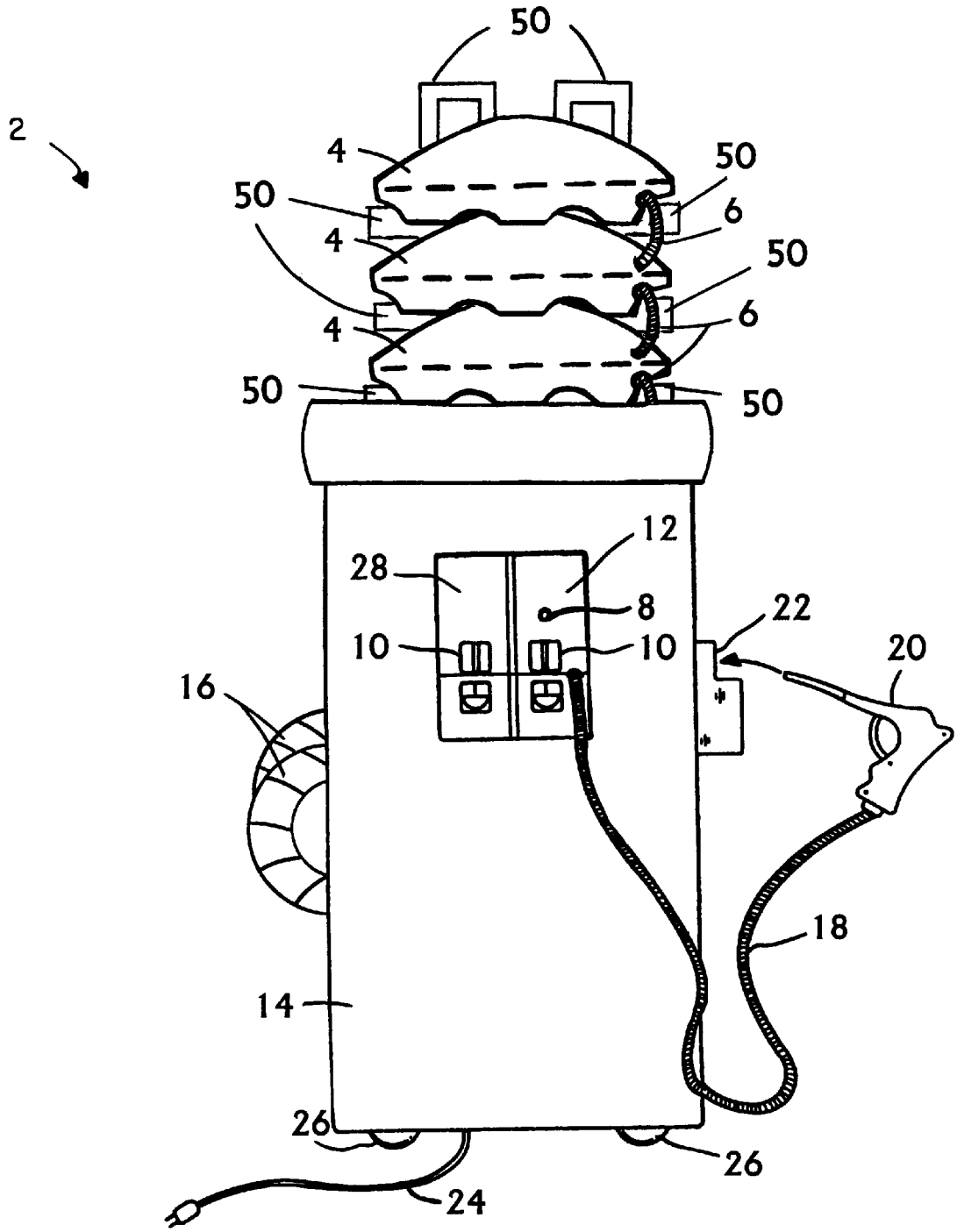
FIG. 4 is a front view of a third preferred embodiment of the present invention combined into a housing unit with an independent system offering air and vacuum services to a motorist, the present invention having multiple partially flattened oval or round windshield washer fluid tanks mounted atop the air and vacuum services housing and having an electrical enclosure separate from the air and vacuum services system.

FIG. 1 shows fluid tube 6 connected through the front surface electrical enclosure 12 above light 8 and the connection of dispensing hose 18 through electrical enclosure 12 below coin/credit-card/debit-card acceptor 10. Although the exact positioning shown in FIG. 1 is not critical, for gravity-fed embodiments fluid tube 6 would necessarily remain in a position superior to discharge hose 18. Also, although FIG. 1 shows an external connection of fluid tube 6 to electrical enclosure 12, it is also considered within the scope of the present invention for fluid tube 6 to extend through housing 14 for connection to electrical enclosure 12, such as is shown in FIG. 4. As a result, instead of connecting through the front surface of electrical enclosure 12, fluid tube 6 in the embodiment of the present invention shown in FIG. 4 would connect through the top, side, or rear surface of electrical enclosure 12. External connection of fluid tube 6 would provide for a faster and easier retrofitting of windshield washer fluid dispensing system 2 to housing 14, however, internal connection of fluid tube 6 to electrical enclosure 12 would be favored in harsh climates and less supervised areas where vandalism might be a concern.

FIG. 1 shows tank 4 having a partially flattened configuration, preferably oval or round, for balanced positioning on top of housing 14, as well as aesthetic appeal. Other flattened and/or compact configurations for tank 4 are also considered within the scope of the present invention. Although not shown in FIG. 1, it is contemplated in the preferred embodiments for tank 4 to have depending brackets or fixtures, such as brackets 50 shown in FIG. 4, that allow it to be bolted to the top of housing 14 for secure attachment of tank 4 to housing 14 during use. Also, although the number of attachment points between tank 4 and housing 14 is not critical, multiple attachment points are contemplated in the most preferred embodiments, such as three or four. FIG. 1 also shows dispensing nozzle 20 having an elongated, tapered dispensing tip adapted for easy, spill-free dispensing of windshield washer fluid into the windshield fluid reservoir of a motor vehicle (not shown). Also in FIG. 1, dispensing nozzle 20 is shown poised for support by holster 22 where it can be conveniently and securely stored during periods of non-use. Although not shown, since payment activates windshield washer fluid flow for a pre-set period of time, dispensing nozzle 20 would comprise an easily controlled fluid cut-off valve which would enable an operator (not shown) to quickly and readily stop the flow of fluid through nozzle 20 upon demand to prevent fluid waste and windshield reservoir overfill. FIG. 1 further shows housing 14 supported by optional feet 26 and a standard current power cord 24 connected to housing 14. The type of feet 26 used to support housing 14 is not critical. Also, instead of feet 26, housing 14 can be bolted to a secure surface (not shown) to deter theft and vandalism, or have wheels or rollers (not shown) so that it may be moved to a secure location at night. Although not limited to the following, in the first preferred embodiment housing 14 could be configured to have width, depth, and height dimensions of approximately three feet, three feet, and six feet, respectively, and electrical enclosure 12 could have maximum width, depth, and height dimensions of approximately twelve inches, six inches, and ten inches, respectively.

Other than the sharing of housing 14 and the optional sharing of electrical enclosure 12, in the present invention it is not contemplated for any other components to be used by both windshield washer fluid dispensing system 2 and the other system or systems within housing 14. Also, although not shown and if housing 14 is sufficiently large to accommodate at least two electrical enclosures 12 and at least two holsters 22 attached to its outside surface, it is contemplated that two or more independent windshield washer fluid dispensing systems 2 could be provided within the same housing 14. Although not shown in FIG. 1 and not critical, electrical enclosure 12 could have a front access door for maintenance access and retrieval of coins 42 deposited into coin vault 46. In the alternative, a back access door through housing 14 could also provide the needed maintenance access to electrical enclosure 12. In either instance, any access door should be made of strong materials, secured by one or more locking devices, and constructed so as to be tamper-resistant. Further, for convenience and cost of manufacture, it is contemplated for all electrical components in the present invention to operate on standard current. FIG. 2 shows electrical enclosure 12 having a hollow interior and coin/credit-card/debit-card acceptor 10 centrally positioned through the front surface of electrical enclosure 12. The positioning of coin/credit-card/debit-card acceptor 10 is not critical as long as when it is used to accept coins 42, it allows coins 42 to drop through opening 44 and be received into coin vault 46. Optionally, although not shown, it is contemplated that when coin/credit-card/debit-card acceptor 10 is used to accept credit and debit cards (not shown), coin/credit-card/debit-card acceptor 10 could be configured to provide operators with a printed receipt. FIG. 2 also shows a pump 36, a solenoid 38, and a fluid regulator 40 connected in sequence to one another between fluid tube 6 and dispensing hose 18. Independent segments of electrical wiring 34 connect pump 36 and solenoid 38 to a timer 30, so that they are both simultaneously activated by timer 30. FIG. 2 further shows timer 30 connected by independent segments of electrical wiring 34 to a light 8 and coin/credit-card/debit-card acceptor 10, with a standard current electrical cord 24 connected to timer 30 and extending through the side of electrical enclosure 12. If the present invention is jointly combined in housing 14 with other systems providing motor vehicle services, although not shown it would be expected for all systems including the present invention to be connected to a single electrical cord 24 that would extend beyond housing 14 for connection to a remote standard current power supply. Connection of timer 30 to electrical cord 24 is not restricted through the side of electrical enclosure 12 and could be through any portion of electrical enclosure 12 most convenient to the purpose. Also, light 8 is not restricted to a position immediately above coin/credit-card/debit-card acceptor 10 and could be connected through the front surface of electrical enclosure 12 in any position that allows it to be easily seen by operators of windshield washer fluid dispensing system 2. It is contemplated for timer 30 to be adjustable by the vendor of windshield washer fluid dispensing system 2 for control of the dispensing period and to help regulate the amount of fluid flow through nozzle 20 per unit payment. Thus, during operation of the first preferred embodiment of the present invention shown in FIG. 2, once a coin 42, or credit or debit card (not shown) was used by an operator to activate windshield washer fluid dispensing system 2, coin/credit-card/debit-card acceptor 10 would send an electrical signal to timer 30. Simultaneously, timer 30 would turn on light 8, activate pump 36, and open solenoid 38. Pump 36 would draw windshield washer fluid (not shown) from tank 4 through fluid tube 6 and cause even flow of the windshield washer fluid through solenoid 38 and into regulator 40. The vendor (not shown) using windshield washer fluid dispensing system 2 would adjust timer 30 and regulator 40 to dispense a predetermined uniform amount of the windshield washer fluid through dispensing hose 18 for each unit payment made. Once the preset time period of dispensing is complete, solenoid 38 would close, pump 36 would become deactivated, and light 8 would cease being lit. Should the active dispensing period cause a surplus of windshield washer fluid beyond that needed to fill the windshield reservoir of a motor vehicle, the operator would use the cut-off valve on nozzle 20 to prevent fluid flow during the time remaining in the dispensing period to prevent reservoir overfill and fluid waste.

Figure 3:
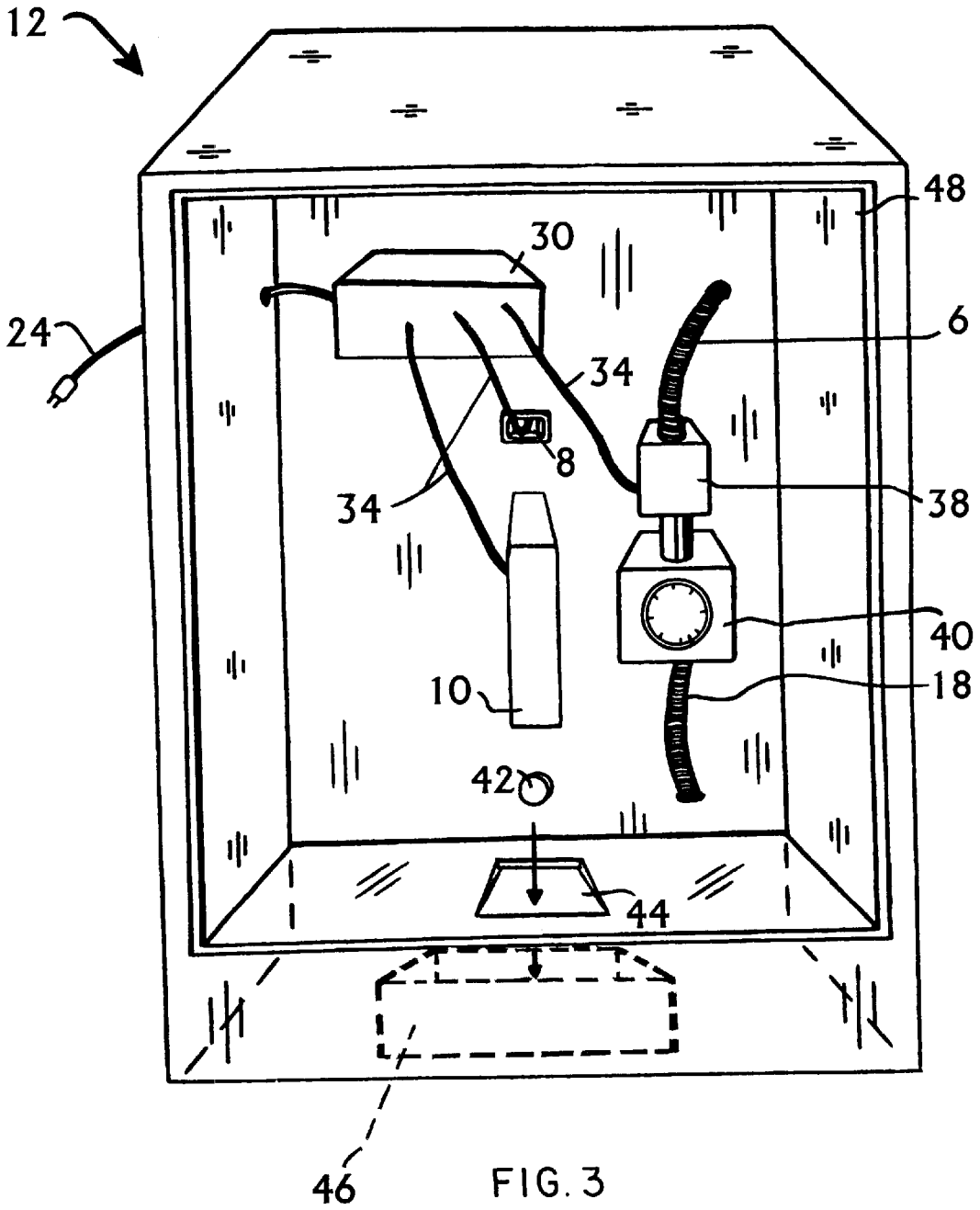
FIG. 3 is an enlarged front view of the electrical enclosure of the gravity-fed second preferred embodiment of the present invention.

FIG. 3 shows a second preferred embodiment of the present invention using gravity-fed flow of windshield washer fluid from a raised tank 4 to provide uniform, evenly flowing, and splash-free dispensing of windshield washer fluid into the windshield fluid reservoir of a motor vehicle (not shown). FIG. 3 shows electrical enclosure 12 having a hollow interior and coin/credit-card/debit-card acceptor 10 centrally positioned through the front surface of electrical enclosure 12. The positioning of coin/credit-card/debit-card acceptor 10 is not critical as long as when it is used to accept coins 42, it allows coins 42 to drop through opening 44 and be received into coin vault 46. Optionally, although not shown, it is contemplated that when coin/credit-card/debit-card acceptor 10 is used to accept credit and debit cards (not shown), coin/credit-card/debit-card acceptor 10 could be configured to provide operators with a printed receipt. FIG. 3 also shows a solenoid 38 and a fluid regulator 40 connected in sequence between fluid tube 6 and dispensing hose 18. Independent segments of electrical wiring 34 connect solenoid 38 and a light 8 to timer 30. An independent segment of electrical wiring 34 connects coin/credit-card/debit-card acceptor 10 to timer 30. FIG. 3 further shows a standard current electrical cord 24 connected to timer 30 and extending through the side of electrical enclosure 12. If the present invention is jointly combined in housing 14 with other systems providing motor vehicle services, although not shown it would be expected for all systems including the present invention to be connected to a single electrical cord 24 that would extend beyond housing 14 for connection to a source of standard current. Also, connection of timer 30 to electrical cord 24 would not be restricted through the side of electrical enclosure 12 and could be achieved through any portion of electrical enclosure 12 convenient for the purpose. Further, light 8 is not restricted to a position immediately above coin/credit-card/debit-card acceptor 10 and could be connected through the front surface of electrical enclosure 12 in any position that allows it to be easily visible to operators of windshield washer fluid dispensing system 2. It is contemplated for timer 30 to be adjustable so that the vendor (not shown) using windshield washer fluid dispensing system 2 is able to control the dispensing time of windshield washer fluid and to help regulate the amount of fluid flow through nozzle 20 per unit payment. Thus, during operation of the first preferred embodiment of the present invention shown in FIG. 3, once a coin 42, or credit or debit card (not shown) was used by an operator to activate windshield washer fluid dispensing system 2, coin/credit-card/debit-card acceptor 10 would send an electrical signal to timer 30. Simultaneously, timer 30 would turn on light 8 and open solenoid 38. As soon as solenoid 38 is opened, windshield washer fluid (not shown) would begin flowing downward from tank 4 through fluid tube 6, through solenoid 38, and into regulator 40. The vendor (not shown) using windshield washer fluid dispensing system 2 would adjust timer 30 and regulator 40 to dispense a pre-determined uniform amount of the windshield washer fluid through dispensing hose 18 for each unit payment made. Once the pre-set time period of dispensing is complete, solenoid 38 would close and light 8 would cease being lit, thus signaling to the operator that fluid will no longer flow through dispensing hose 6. Should the active dispensing period cause a surplus of windshield washer fluid beyond that needed to fill a targeted windshield reservoir, the operator would use the cut-off valve on nozzle 20 to prevent fluid flow during the time remaining in the dispensing period to prevent reservoir overfill and fluid waste.

FIG. 4 shows the present invention windshield washer fluid dispensing system 2 set up in a housing 14 that also provides air/vacuum services, similar to FIG. 1, except three tanks 4 are stacked upon one another above the top surface of housing 14. Multiple tanks 4 could be used to minimize maintenance of windshield washer fluid dispensing system 2 in locations where high customer use is anticipated. Although internal connection through housing 14 is shown in FIG. 4, it is contemplated in the preferred embodiment for the fluid tube 6 from the lowermost tank 4 to be either internally or externally connected to electrical enclosure 12. Also, although FIG. 4 shows each upper tank 4 connected by a fluid tube 6 to the tank 4 immediately therebelow, it is optionally contemplated for each upper tank 4 to be directly connected through the upper surface of housing 14 and to different dispensing hoses 18, or to a device which alternatively diverts fluid from successively higher tanks 4 toward electrical enclosure as each lower tank 4 is emptied. Further, it is contemplated for all tanks 4 to have depending fixtures or brackets 50 that allow it to be securely connected to adjacent tanks 4 and/or housing 14. The configuration of brackets 50 is not critical as long as secure connection can be achieved. The fluid communication between tanks 4 should be tamper-resistant, but at the same time allow easy access and manipulation by authorized maintenance personnel (not shown) during filling or change-out of tanks 4. The number of tanks 4 is not critical, however, it is contemplated that the number of tanks 4 will be limited by the fluid capacity of each tank 4, as well as the strength of the materials used to construct housing 14. FIG. 4 could represent either a new unit manufactured to provide both types of services jointly within housing 14, or an existing housing 14 designed to provide air/vacuum services with the present invention retrofitted therein to expand the functionality and profitability of housing 14. FIG. 4 shows the present invention having a housing 14, three tanks 4, an electrical enclosure 12, fluid connection between adjacent tanks 4 and between the lowermost tank 4 and electrical enclosure 12 through fluid tubes 6, a discharge hose 18 connected to electrical enclosure 12, a nozzle 20 connected to the distal end of discharge hose 18 with an elongated dispensing tip and an operator-controlled fluid cut-off valve (not shown), as well as a holster 22 attached to housing 14 for support of nozzle 20 during periods of non-use. FIG. 4 shows air/vacuum services being dispensed through use of electrical panel 28, a coin/credit-card/debit-card acceptor 10, and hoses 16. Both electrical panel 28 and electrical enclosure 12 comprise a coin/credit-card/debit-card acceptor 10 centrally located therethrough. Since tanks 4 are in elevated positions relative to dispensing hose 18, the windshield washer fluid dispensing system 2 shown in FIG. 4 could represent either a gravity-fed embodiment of the present invention, or one in which fluid flow is pump-assisted. FIG. 4 further shows electrical enclosure 12 comprising a light 8 for activation during each dispensing period, housing 14 being supported by optional feet 26, and an electrical cord 24 extending through housing 14 for connection to a remote standard current power supply (not shown).

Figure 5:
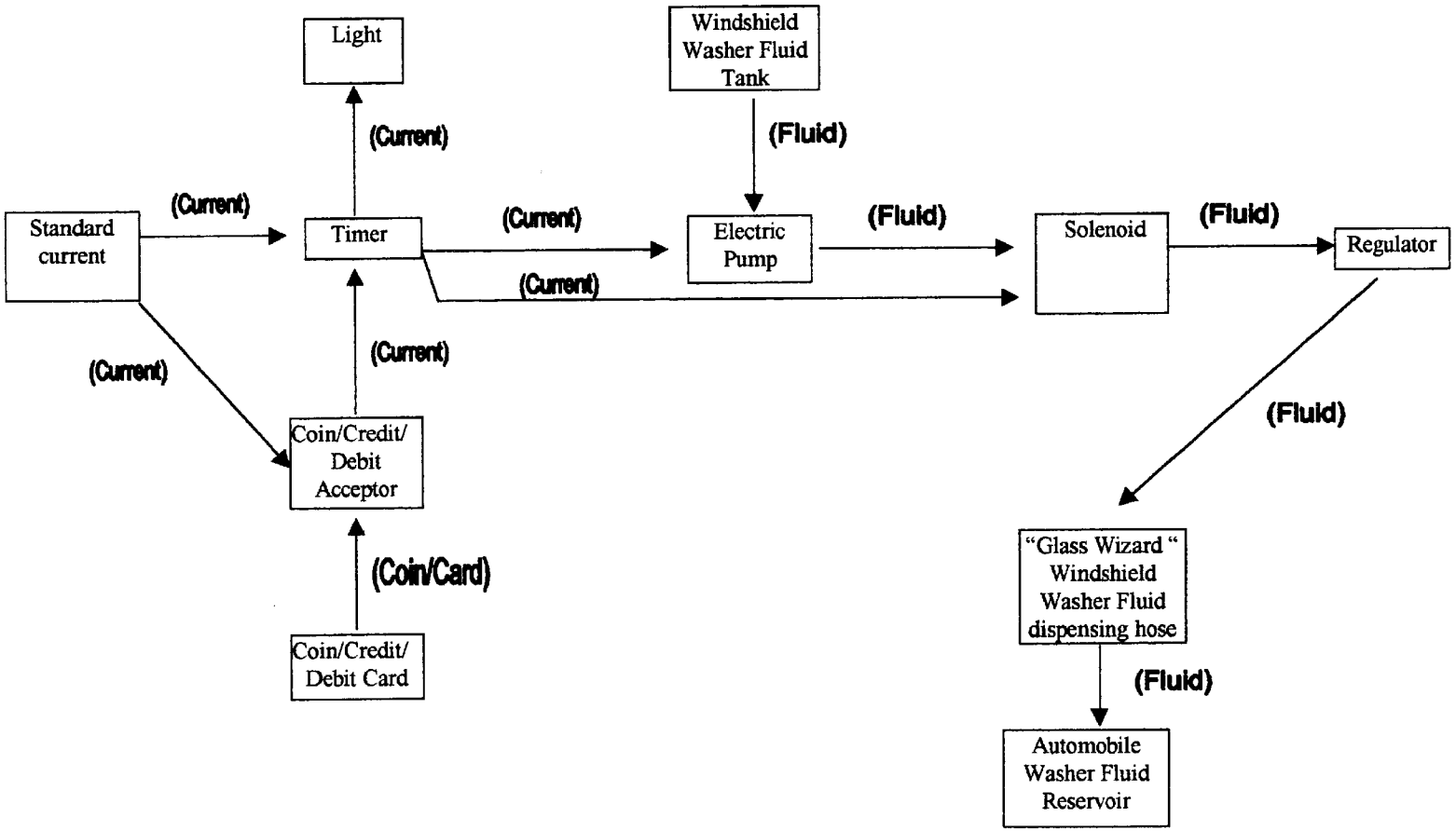
FIG. 5 is a schematic view of the pump-activated first preferred embodiment of the present invention.
Figure 6:
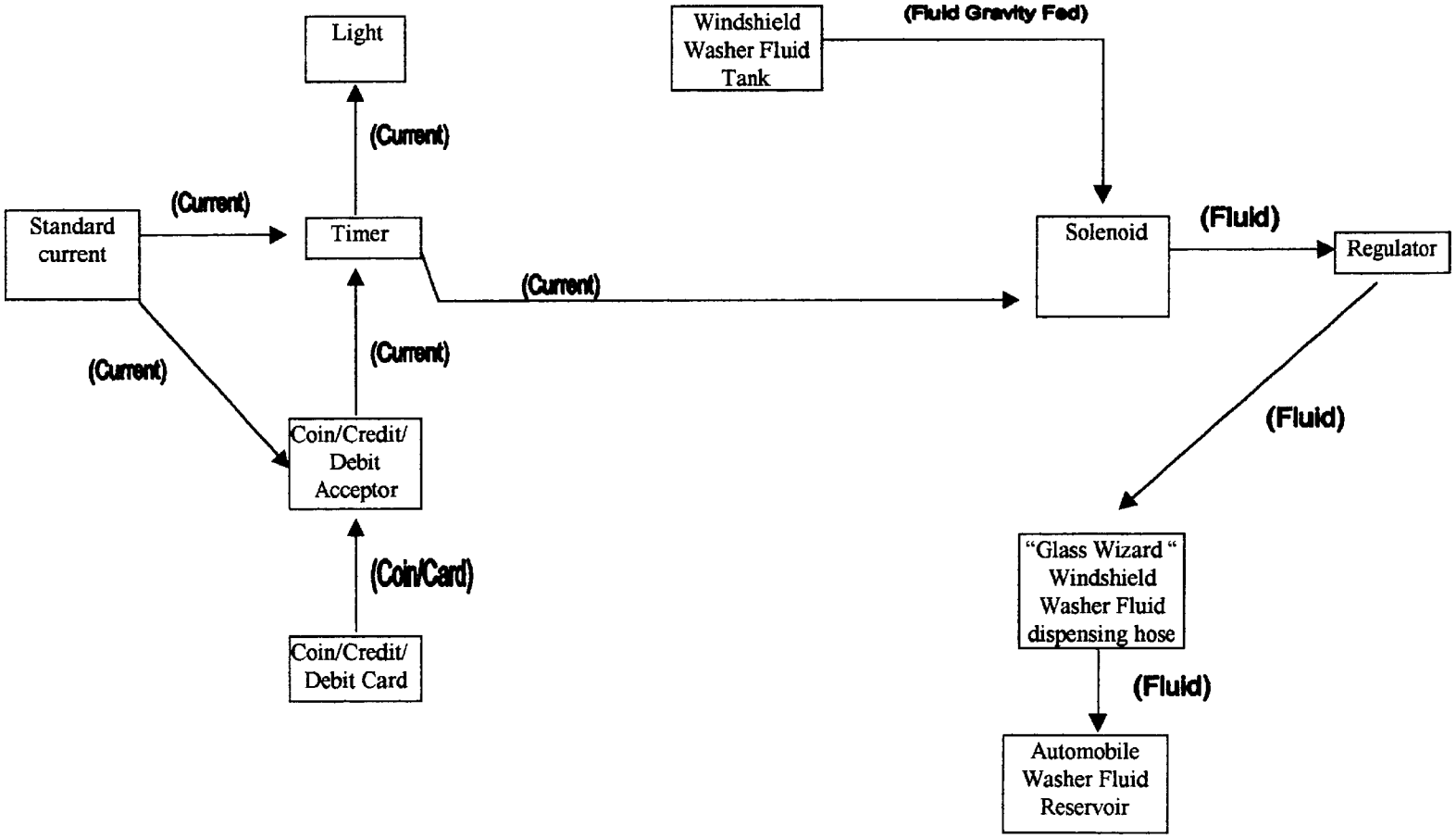
FIG. 6 is a schematic view of the gravity-fed second preferred embodiment of the present invention.

FIGS. 5 and 6 show the first and second preferred embodiments of the present invention, respectively, in which a 120-volt remote power source (not shown) provides the power required to operate the present invention. An electrical cord 24 would be connected between the remote power source and timer 30. In the pump-assisted embodiment shown in FIG. 5, timer 30 is electrically connected to coin/credit-card/debit-card acceptor 10, light 8, pump 36, and solenoid 38 through independent segments of electrical wiring 34. In the gravity-fed embodiment of the present invention shown in FIG. 6, timer 30 is electrically connected to coin/credit-card/debit-card acceptor 10, light 8, and solenoid 38 through independent segments of electrical wiring 34. In FIG. 5, upon activation of timer 30 by insertion of a coin 42 or credit or debit card (not shown) into coin/credit-card/debit-card acceptor 10, timer simultaneously sends electrical signals to light 8, pump 36, and solenoid 38 to activate them, and to solenoid 38 to open it. In FIG. 6, upon activation of timer 30 by insertion of a coin 42 or credit or debit card (not shown) into coin/credit-card/debit-card acceptor 10, timer 30 simultaneously sends electrical signals to light 8 to activate it, and to solenoid 38 to open it. Thereafter, windshield washer fluid is made to flow through solenoid 38, subsequently through regulator 40, and through dispensing hose 18 and nozzle 20 for delivery into the windshield fluid reservoir of a motor vehicle (not shown). Light 8 remains illuminated as long as fluid flow occurs. Once the pre-determined amount of time per unit payment for fluid dispensing is concluded, light 8 ceases to be lit, solenoid 38 closes, pump 36 is deactivated where used, and new windshield washer fluid from tank 4 is no longer permitted to flow toward dispensing hose 18. While dispensing occurs, it is neat and even, without splashing or spillage, precisely calibrated, and without the need of a funnel (not shown).

To use the present invention, the person (not shown) responsible for its maintenance would place windshield washer fluid within tank 4, and connect power cord 24 to a remote 120-volt power source (not shown). Then through adjustment of timer 30, regulator 40, or both, the maintenance person would calibrate the present invention to have nozzle 20 dispense a predetermined amount of windshield washer fluid for a pre-set monetary charge. Thereafter, when an operator (not shown) lifts nozzle 20 from holster 22, and places the distal end of nozzle 20 within the opening in a vehicle windshield washer fluid reservoir (not shown), and that operator further places a coin 42 or a credit or debit card (not shown) in coin/credit-card/debit-card slot 10, a pre-set amount of windshield washer fluid will be transferred into the vehicle reservoir without splashing or spilling, or use of a funnel. On-off light 8 will become illuminated after insertion of coin 42 or a credit or debit card to confirm commencement of the time period for windshield washer fluid dispensing. If the operator sees that the vehicle reservoir is nearly full and light 8 remains lit, the operator can engage the cut-off control on nozzle 20 until such time as the short dispensing period is completed to prevent overfill and fluid waste. Upon completion of dispensing, the operator would replace nozzle 20 within holster 22, unless a second time period of dispensing is desired. Thus, the present invention would provide neat, easy, and rapid use by an operator. Periodic maintenance of the present invention would entail refilling fluid tank 4 at regular intervals with windshield washer fluid, systematic re-calibration and documentation of the amount of windshield washer fluid dispensed per unit monetary charge, and periodic removal of coins 42 and/or credit-card/debit-cards records from electrical enclosure 12.

What is claimed is:

1. A dispensing system for neatly transferring a metered quantity of windshield washer fluid into a motor vehicle reservoir without fluid spills and without use of a funnel, said system comprising:

a housing made from strong, tamper-resistant materials and having an outside surface;

a fluid tank adapted for support by said housing and secure attachment to said housing, said fluid tank having at least one opening therethrough;

an amount of said windshield washer fluid, said amount being greater than said metered quantity, said windshield washer fluid being positioned within said fluid tank;

at least one dispensing nozzle having an elongated nozzle with a distal end, said distal end of said nozzle having a diameter sufficiently small to fit within the upper opening of most motor vehicle windshield washer fluid reservoirs, said dispensing nozzle comprising an easily operated manual fluid cut-off control;

support means for supporting said dispensing nozzle during periods of non-use, said support means being attached to said outside surface of said housing;

at least one solenoid positioned within said cabinet and configured so as to have an opened position and a closed position to control flow of said windshield washer fluid between said fluid tank and said nozzle;

an adjustable low pressure regulator connected between said solenoid and said nozzle;

a first hose connected between said opening in said fluid tank and said solenoid;

a second hose connected between said solenoid and said dispensing nozzle;

a quantity of electrical wiring; an adjustable timer configured for use in establishing dispensing period during which each of said metered quantities of said windshield washer fluid will be transferred to said dispensing nozzle and electrically connected with said wiring to said solenoid;

a power cord having a distal end and a proximal end, said distal end being configured and dimensioned for connection to a remote standard current power source, and said proximal end being connected through said cabinet to said timer;

payment accepting means attached to said housing and electrically connected with said wiring to said timer; and at least one on-off light electrically connected with said wiring to said timer which when lit indicates to a system operator that said solenoid is in said opened position to allow flow of said windshield washer fluid to said dispensing nozzle so that when a system operator places sufficient payment within said payment accepting means, said solenoid will be opened and said system operator can then manipulate said cut-off control on said dispensing nozzle to allow a selected amount of said metered quantity of said windshield washer fluid to be promptly, neatly, and gently transferred through said dispensing nozzle under low pressure and directly into a motor vehicle windshield washer fluid reservoir without spillage, without use of a funnel, and without overfill.

2. The system of claim 1 wherein said payment accepting means comprises at least one coin/credit-card/debit-card acceptor.

3. The system of claim 1 wherein said nozzle support means comprises a holster configured and dimensioned for secure support of said dispensing nozzle and nozzle when said dispensing nozzle is not in use, and easy prompt release of said dispensing nozzle and nozzle for use when needed by a system operator.

4. The system of claim 1 wherein said fluid tank is attached to said housing in an elevated position higher than said nozzle so that when said solenoid is placed into said opened position, said windshield washer fluid will be gravity-fed into said dispensing nozzle for direct transfer into a motor vehicle windshield fluid reservoir.

5. The system of claim 1 further comprising an electrical pump connected between said fluid tank and said solenoid, said pump being electrically connected to said timer with said wiring for simultaneous activation when said solenoid is opened.

6. The system of claim 5 wherein said payment accepting means, said on-off light, said timer, said pump, said solenoid, and said regulator are housed in an electrical enclosure.

7. The system of claim 1 wherein said payment accepting means, said on-off light, said timer, said solenoid, and said regulator are housed in an electrical enclosure.

8. The system of claim 1 wherein said housing also comprises a dispensing unit for air and vacuum services.

9. A dispensing system for neatly transferring a metered quantity of windshield washer fluid to a motor vehicle reservoir without spillage and without use of a funnel, said system comprising:

a housing made from strong tamper-resistant materials;

a fluid tank supported by and securely attached to said housing, said fluid tank having at least one opening therethrough;

an amount of said windshield washer fluid positioned within said fluid tank, said amount being greater than one of said metered quantities;

a plurality of solenoids positioned within said housing;

a plurality of first hoses, one of said first hoses being connected between said opening in said fluid tank and each of said solenoids;

a plurality of low pressure regulators positioned within said housing;

a quantity of electrical wiring;

a plurality of adjustable timers positioned within said housing and adapted for establishing a dispensing period during which each of said metered quantities of said windshield washer fluid will be dispensed from said nozzles, each of said timers being electrically connected with said wiring to a different one of said solenoids;

a plurality of dispensing nozzles each having an elongated nozzle with a distal end, each of said distal ends having a diameter sufficiently small to fit within the opening of most motor vehicle windshield washer fluid reservoirs;

a plurality of second hoses, one of said second hoses being connected between each of said regulators and one of said dispensing nozzles;

support means configured for supporting each of said dispensing nozzles during periods of non-use, said support means attached to said housing;

a plurality of on-off lights, each of said on-off lights being electrically connected with said wiring to one of said timers and to one of said transformers which when lit indicates to a system operator that the one of said solenoids connected to said lit on-off light is in an opened position to allow flow of said windshield washer fluid through the one of said nozzles connected thereto;

a plurality of payment accepting means, each of said payment accepting means being electrically connected with said wiring to one of said timers; and a power cord having a distal end and a proximal end, said distal end of said power cord being configured and dimensioned for connection to a remote power source, said proximal end of said power cord being connected through said housing to said timers so that a system operator's placement of sufficient payment within said payment accepting means will cause the one of said solenoids to be placed in said opened position and said windshield washer fluid will flow from said fluid tank evenly and smoothly into the one of said dispensing nozzles connected said pump so that said system operator can manipulate said cut-off control on said dispensing nozzle to allow a selected amount of said metered windshield washer fluid to be neatly and gently transferred under low pressure directly into a selected motor vehicle windshield washer fluid reservoir without spillage, without use of a funnel, and without overfill.

10. The system of claim 9 wherein said payment accepting means comprises at least one coin/credit-card/debit-card acceptor.

11. The system of claim 9 wherein said nozzle support means comprises a plurality of holsters each configured and dimensioned for secure support of one of said dispensing nozzles during periods of non-use, and easy prompt release of said dispensing nozzles for use when needed by a system operator.

12. The system of claim 9 wherein each said fluid tank is attached to said housing in an elevated position higher than said nozzles so that when said solenoids are placed into said opened positions, said windshield washer fluid will be gravity-fed into said dispensing nozzles for direct transfer into a motor vehicle windshield fluid reservoir.

13. The system of claim 9 further comprising an electrical pump connected between said fluid tank and said solenoid, said pump being electrically connected to said timer with said wiring for simultaneous activation when said solenoid is opened.

14. The system of claim 13 wherein said payment accepting means, said on-off light, said timer, said pump, said solenoid, and said regulator are housed in an electrical enclosure.

15. The system of claim 9 wherein said payment accepting means, said on-off light, said timer, said solenoid, and said regulator are housed in an electrical enclosure.

16. The system of claim 9 wherein said housing also comprises a dispensing unit for air and vacuum services.

17. A method for metered dispensing of windshield washer fluid, said method comprising the steps of:

providing a housing, at least one fluid tank, a remote standard current power source, at least one payment acceptor, at least one on-off light, at least one timer, at least one solenoid, at least one low pressure fluid regulator, a quantity of windshield washer fluid, a plurality of hoses, a quantity of electrical wiring, a power cord, and at least one dispensing nozzle each with an elongated tip and an easily operated fluid cut-off control;

using said electrical wiring to connect a first one of said timers to a first one of said payment acceptors, a first one of said on-off lights, and a first one of said solenoids;

placing said first timer, said first on-off light, and said first payment acceptor within said housing;

also placing said fluid tank into an elevated position within said housing;

using a first one of said hoses to connect said first solenoid to a first one of said fluid tanks and place said first solenoid in fluid communication with said first fluid tank;

connecting said first solenoid to a first one of said low pressure fluid regulators;

using a second one of said hoses to connect said first low pressure fluid regulator to a first one of said dispensing nozzles;

adjusting said first timer to define a dispensing period within which said first dispensing nozzle is able to transfer a desired amount of said windshield washer fluid;

using said power cord to connect said remote standard current power source to said first timer so that an operator's placement of a predetermined amount of payment into said first payment acceptor will activate said first timer and illuminate said first on-off light, said first timer will open said first solenoid for said dispensing period, said first solenoid will allow flow of said metered quantity of said windshield washer fluid through said first low pressure fluid regulator and into said first dispensing nozzle, said flow being controllable by said operator who can promptly stop said flow by manipulation of said cut-off control on said dispensing nozzle; and the steps of connecting the remaining ones, if any of said timers, said payment acceptors, said solenoids, and said hoses in a like manner to said connection of said first timer, said first payment acceptor, said first solenoid, said first low pressure fluid regulator; and said first and second hoses to provide simultaneous metered dispensing of said windshield washer fluid to more than one system operator.

18. The method of claim 17 further comprising said steps of providing a plurality of pumps; placing said pumps, within said housing; electrically connecting said first timer to a first one of said pumps; and connecting the remainder of said pumps in a like manner to said connection of said first pump, to provide simultaneous metered dispensing of said windshield washer fluid to more than one operator.

19. The method of claim 18 further comprising the steps of providing a plurality of electrical enclosures, and placing said on-off lights, said payment acceptors, said pumps, said solenoids, and said low pressure regulators within said electrical enclosures to provide an identical number of each of said on-off lights and said payment acceptors within each of said electrical enclosures.

20. The method of claim 17 further comprising the steps of providing a plurality of electrical enclosures, and placing said on-off lights, said payment acceptors, said solenoids, and said low pressure regulators within said electrical enclosures to provide an identical number of each of said on-off lights and said payment acceptors within each of said electrical enclosures.

* * * * *